US010406586B2

(12) United States Patent
Frenken

(10) Patent No.: US 10,406,586 B2
(45) Date of Patent: Sep. 10, 2019

(54) PORTABLE TOOL AND METHOD OF OPERATING SAME

(71) Applicant: Gustav Klauke Gmbh, Remscheid (DE)

(72) Inventor: Egbert Frenken, Heinsberg (DE)

(73) Assignee: GUSTAV KLAUKE GMBH, Remscheid (DE)

( * ) Notice: Subject to any disclaimer, the term of this patent is extended or adjusted under 35 U.S.C. 154(b) by 474 days.

(21) Appl. No.: 14/432,043

(22) PCT Filed: Sep. 26, 2013

(86) PCT No.: PCT/EP2013/070038

§ 371 (c)(1),
(2) Date: Mar. 27, 2015

(87) PCT Pub. No.: WO2014/049035

PCT Pub. Date: Apr. 3, 2014

(65) Prior Publication Data

US 2015/0258598 A1 Sep. 17, 2015

(30) Foreign Application Priority Data

Sep. 28, 2012 (DE) ..... 10 2012 109 255

(51) Int. Cl.
*B21D 39/20* (2006.01)
*F15B 15/06* (2006.01)

(52) U.S. Cl.
CPC ..... *B21D 39/203* (2013.01); *B21D 39/20* (2013.01); *F15B 15/063* (2013.01)

(58) Field of Classification Search
CPC .. B21D 39/203; B21D 41/026; B21D 41/028; B29C 57/045; B29C 57/04; B29C 57/08
See application file for complete search history.

(56) References Cited

U.S. PATENT DOCUMENTS 3,857,666 A 12/1974 Barnett
3,861,847 A 1/1975 Barnett
(Continued)

FOREIGN PATENT DOCUMENTS

DE 102 47 549 B3 5/2004
EP 927 305 B1 7/1999
(Continued)

OTHER PUBLICATIONS

International Search Report for PCT/EP2013/070038 dated Feb. 7, 2014, 14 pages.
(Continued)

*Primary Examiner* — Debra M Sullivan
(74) *Attorney, Agent, or Firm* — Klintworth & Rozenblat IP LLP

(57) ABSTRACT

A portable tool having a working head that is actuated by an electric motor and/or a hydraulic medium and has a working part. The working part is displaceable in a displacement direction and the working head is rotatable together with the working part in the circumferential direction with respect to the displacement direction. The working head is rotatable together with the working part hydraulically and by the motor. The working head has a segment mounted therein, the segment having a largest extension in the circumferential direction by a first angular amount, and that the rotation of the working head and the working part takes place in the circumferential direction by a second angular amount, wherein values of the first and the second angular amounts are different. Moreover, a method for operating a portable tool is provided using first and second hydraulic pistons.

14 Claims, 15 Drawing Sheets

(56) References Cited

U.S. PATENT DOCUMENTS

| | | | |
|---|---|---|---|
| 6,206,663 | B1 | 3/2001 | Frenken |
| 6,230,542 | B1 | 5/2001 | Frenken |
| 6,276,186 | B1 | 8/2001 | Frenken |
| 6,401,515 | B2 | 6/2002 | Frenken |
| 6,446,482 | B1 | 9/2002 | Heskey |
| 6,532,790 | B2 | 3/2003 | Frenken |
| 7,065,995 | B2 | 6/2006 | Frenken |
| 7,254,982 | B2 | 8/2007 | Frenken |
| 7,412,868 | B2 | 8/2008 | Frenken |
| 7,421,877 | B2 | 9/2008 | Frenken |
| 7,922,475 | B2 | 4/2011 | Gueit |
| 8,303,295 | B2 | 11/2012 | Gueit |
| 8,517,715 | B2 | 8/2013 | Thornson et al. |
| 8,562,331 | B2 | 10/2013 | Schramm et al. |
| 8,763,439 | B2 | 7/2014 | Thorson et al. |
| 2002/0002883 | A1 | 1/2002 | Rahmsdorf et al. |
| 2005/0210872 | A1 | 9/2005 | Wagner |
| 2008/0289461 | A1 | 11/2008 | Anson |
| 2009/0008118 | A1 | 1/2009 | Frenken |
| 2009/0084234 | A1 | 4/2009 | Pertot et al. |
| 2010/0308503 | A1 | 12/2010 | Schramm et al. |
| 2011/0239425 | A1 | 10/2011 | Thorson et al. |
| 2013/0341831 | A1 | 12/2013 | Thorson et al. |

FOREIGN PATENT DOCUMENTS

| | | | |
|---|---|---|---|
| EP | 1170093 | A2 | 1/2002 |
| EP | 2 011 605 | A2 | 1/2009 |
| EP | 2374554 | A1 | 10/2011 |
| GB | 2449638 | A | 12/2008 |
| SU | 538778 | | 12/1976 |
| SU | 1430149 | | 10/1988 |
| WO | 99/19947 | A | 4/1999 |
| WO | 02/062504 | A1 | 8/2002 |
| WO | 03/084719 | A2 | 10/2003 |
| WO | 03/097304 | A1 | 11/2003 |
| WO | 2007/107273 | A2 | 9/2007 |
| WO | 2009/000966 | A1 | 12/2009 |
| WO | 2012/123284 | A1 | 9/2012 |
| WO | 2012/149919 | A1 | 11/2012 |

OTHER PUBLICATIONS

Machine translation of RU2104114.
Machine Translation of SU1430149.

PORTABLE TOOL AND METHOD OF OPERATING SAME

FIELD OF THE INVENTION

The invention primarily relates to a portable tool according to the features of the preamble of claim 1. The invention further relates to a portable expanding apparatus according to the features of the preamble of claim 2, a hydraulic piston/cylinder arrangement according to the features of the preamble of claim 3 and a method for operating a portable tool according to the features of the preamble of claim 4.

BACKGROUND OF THE DISCLOSURE

Portable tools of such kind, also having the hydraulic piston/cylinder assemblies described, are already known in many different forms. For example, WO 99/19947 A and U.S. Pat. No. 6,532,790 B2, U.S. Pat. No. 6,401,515 B2, U.S. Pat. No. 6,276,186 B1, or U.S. Pat. No. 6,230,542 B1, WO 02/062504 A1 and U.S. Pat. No. 7,065,995 B2, WO 03/084719 A2 and U.S. Pat. No. 7,254,982 B2, U.S. Pat. No. 7,412,868 B2, or U.S. Pat. No. 7,421,877 B2 and EP 2 011 605 A2 and US 2009/0008118 A1 may be cited as examples of the prior art. In this context, the cited documents WO 02/062504 A1 and U.S. Pat. No. 7,065,995 B2 relate to an expanding apparatus, but the apparatus is of a kind in which expansion is effected by compressing an elastic rubber expansion element.

An expanding apparatus that is powered by an electric motor and actuated hydraulically, in which spreading segments actuated by an expanding mandrel are provided is also known from DE 102 47 549 B3.

SUMMARY

A threaded device in which a screw-in spindle is introduced into a working head is known from EP 1170093 A2. The screw-in spindle is provided with a screwdriver bit at the tip.

On the basis of the prior art as outlined in the preceding, the invention is concerned with the task of suggesting a portable tool, in particular a portable expanding apparatus that is actuated hydraulically and/or by an electric motor, and with an improved design. More generally, the invention is also concerned with the task of suggesting an advantageous hydraulic piston/cylinder arrangement and/or a method for operating a portable tool.

One possible solution to the task is realized according to a first inventive concept of the invention with a portable tool based on the fact that the working head is rotatable together with the working part hydraulically and/or by the action of the motor. Thus, a portable tool is described in which not only is it possible to displace the working part in a displacement direction by the even application of force, but the working head is also rotatable, optionally together with the working part, by the application of a hydraulic or immediately motor force. Various circumferential angle positions of the working head may easily be achieved. Optionally, the motorized movement of the working part and the rotation of the working head may be achievable by the action of said motor and/or of the overall hydraulic medium in the portable tool.

For the purposes of the present application, a portable tool is understood in particular to be a hand tool that is moved by the external force, hydraulically.

Regarding a portable expanding apparatus, another possible solution to the task consists in that the segments are movable in the circumferential direction of the circular arrangement by the application of force by hydraulic medium or a motor, optionally a geared motor. Thus, the segments may not only be spread by the action of such a force, but are also moved in the circumferential direction. Moreover, since there are always interspaces associated with segments, or transitions between individual segments, in which transitions the expansion causes inconsistencies at a corresponding inner surface of the pipe or pipe end, such a displacement of the segments in a circular direction may bring them to another position with which such irregularities may be compensated.

With regard to a hydraulic piston/cylinder arrangement of a more general nature, another possible solution to the task consists in that the first hydraulic cylinder is rotatable in the mounting, that a second hydraulic cylinder is provided with a second piston, and that rotation about the longitudinal axis thereof may be effected by the action of the second piston on the first hydraulic cylinder. In this context, the second hydraulic cylinder and the second hydraulic piston may also be arranged in the same mounting, or in a mounting that is attached or attachable to the first mounting.

Regarding the method, a solution to the problem is achieved in that when displacement of the working part is initiated a rotation of the working head together with the working part is effected without further intervention by the user.

In the method described, but also in the other portable tools described in the preceding text, the working head preferably rotates relative to a grip section, by which the user holds the portable tool. The user can therefore also apply the requisite counter-torque against the rotation. This is particularly significant in the case of an expanding apparatus in the narrower sense, because in this case the rotation preferably takes place when a certain expanding pressure is still being exerted by the working part or the expanding mandrel, on an inner surface of a pipe end, for example.

The features described in the following specifically for the portable expanding apparatus are also significant for the portable tool of a more general configuration, in which it is not important whether the working head is an expanding head. Accordingly, descriptions relating to the expanding mandrel also have implications for the working part of the portable tool of a more general nature. Similarly, features that are described with reference to the working head and the working part of the portable tool may also be significant for a specific embodiment as an expanding mandrel or an expanding working head. Finally, but equally important, features that are described with respect to the rotatability of the portable expanding apparatus and/or of the motor-driven and/or hydraulically actuated portable tool, or the more specific configurations of each, may be applicable to the more specific embodiment of the hydraulic piston/cylinder arrangement of a more general type.

The portable tool may also consist of a working head that is connected, via a hose line for example, to a device that is operable by foot or by a motor to generate hydraulic pressure.

More specifically, it is preferred that the working part is movable between an operating position and a starting position, and that rotation continues while the working part is moving from the operating position to the starting position. Although in principle the rotation may initially take place independently of a movement of the working part, it is correspondingly preferable for the rotation to be linked to a movement of the working part. More specifically, it is preferred that the rotation takes place when the working part is moved back from the working position to the starting position or when it has completed said return movement. With reference to the expanding mandrel, this is a movement in which the expanding mandrel returns or has been moved from the spread position to the starting position.

The rotation of the working head, optionally also together with the working part, may initially take place in dependence on the movement of the working part. For example, this may be caused by the returning piston, optionally acting on the working part via a fixed rotating spindle, which is reversible to rotate in the opposite direction, somewhat in the manner of a ratchet gear.

In this respect, however, it is preferred that the rotation is triggered by the oil pressure falling below a given value when the portable tool or the expanding apparatus is actuated hydraulically by the action of the electric motor.

One possible configuration of such is explained later in this document.

A further preferred variant relates to the configuration of the expanding segments relative to the rotation. A segment has a largest extension in the circumferential direction by a first circumferential angular value. The rotation in the circumferential direction takes place by a second angular value, wherein it is provided that the first and second angular values are different. In this simple manner, it is possible for such a rotation, relative to a further expansion operation for example, to be performed such that the actuation takes place on a region on the inner surface of the pipe to be expanded that previously corresponded to the transition between two segments, but lies outside of the transition between two segments after the rotation.

In particular it is preferred that the second angular value is smaller than the first angular value, wherein it is particularly advantageous to provide a second angular value that is equivalent to approximately half the first angular value.

Another possible configuration is realized if there is no limit on the angle through which the working head or expanding head is able to rotate. However, it is preferable that a rotation is only ever performed through an angle that is significantly smaller than an angle equivalent to a complete revolution, i.e. 360 degrees. For example, a rotation through 15 or 30 degrees. However, it is further preferably provided that any further rotation in the same direction would be made without a limitation on the angle of rotation, that is to say the working or expanding head would have to be rotated back to enable a further rotation in the same direction.

Accordingly, it is preferred, that a rotation or sequence of rotations always occurs or is carried out in the same rotational direction.

As regards the work process, it is also particularly preferred that the rotary movement operation of the working head or expanding head is triggered without the need for any further user intervention. In this way in particular, it is possible for the triggering of a work process, e.g., a compressing or expanding operation, to initiate the rotation of the working head at the same time. In particular, it is also further preferred for the rotation to take place in a preset temporal sequence relative to the triggering of a return of the working part or actuator. The rotation may initially begin at the same time as the triggering of a work operation, that is to say it may take place approximately in parallel with the start of a movement of a (first) hydraulic piston. The rotation may also be performed so as to begin at the same time as the start of a return movement of the (first) hydraulic piston, or more generally after the work operation is completed. However, it is preferred that the rotation is not directly linked to the triggering of the return travel of the actuator, but with a certain time delay. Specifically, this time delay may also be predetermined by making it dependent on the hydraulic piston/cylinder arrangement. Since during a return travel the point in time at which the pressure falls below a certain level occurs in approximately reproducible manner, starting with the triggering of the return travel, to this extent a temporal sequence is also achieved.

As has already been described as an option several times, it is particularly preferable that the actuator and/or the rotation of the working head is set in motion by a hydraulic medium that is placed under pressure by the motor. For this purpose, one or more, possibly two hydraulic piston/cylinder arrangements are provided, in suitable manner.

It is also particularly preferred if the working head or expanding head is not movable without being acted on by a motor or by a pressurized hydraulic medium. Accordingly, without an actuation to initiate a working operation with the portable tool, and further preferably outside the specified time window during the return travel of the actuator in which working head rotates, a correspondingly preferable rigid coupling exists between the working head and the other parts of the tool.

It is also particularly preferred that the movement of the actuator and/or the rotation of the working head is effected by the movement of a hydraulic piston in a hydraulic cylinder, wherein the hydraulic piston is biased in a starting position by a return spring. In particular, a first hydraulic piston may be provided to move the actuator, and a second hydraulic piston, wherein second hydraulic piston generates the rotation. It is further preferred that the second hydraulic piston that generates the rotation is biased in its starting position by a greater biasing force than that of the first hydraulic piston acting on the actuator. This applies at least to a first section of the movement of the first hydraulic piston. Said load is calculated for a given hydraulic pressure by the effective area of the hydraulic piston on the one hand and the force of the biasing return spring on the other. In this way, a movement to a rotary starting position by the second hydraulic piston, which generates the rotation, will not take place until a time after the first hydraulic piston moves or begins to move.

In the same way, however, the hydraulic piston also returns to its starting position before the hydraulic piston acting on the actuator has reached its starting position again, so that the rotary movement of the working head, preferably generated as described from the return movement of the hydraulic piston that acts on the actuator, is completed before the hydraulic piston acting on the actuator reached its starting position again.

It is further preferred that the working head does not perform a rotary motion until the actuator has been retracted, or has been at least substantially retracted. Regarding the expanding apparatus, in this context it is particularly preferred that at the start of the rotating movement the expanding mandrel is retracted to such a point that the segments can easily be rotated in the circumferential direction within the pipe end to be expanded without the need for the user to apply increased counter-force on the expanding apparatus.

In this context as well, it is preferred that the first hydraulic piston has a return spring that has a variable spring characteristic depending on the restoring path. Specifically, on a first part of the return path it exerts a very high spring force and on another part of the return path it exerts a lower spring force. During the period in which said high restoring force of the return spring is effective, the pressure in the hydraulic medium that provides the actuating force is so high that the second hydraulic piston does not complete a return movement. Instead, it only returns when the lower spring force of the return spring on the first hydraulic piston is effective.

BRIEF DESCRIPTION OF THE DRAWINGS

In the following, the invention will be explained further with reference to the accompanying drawing, which however illustrates only one embodiment. In the drawing.

DETAILED DESCRIPTION OF THE ILLUSTRATED EMBODIMENTS

Figure 1:
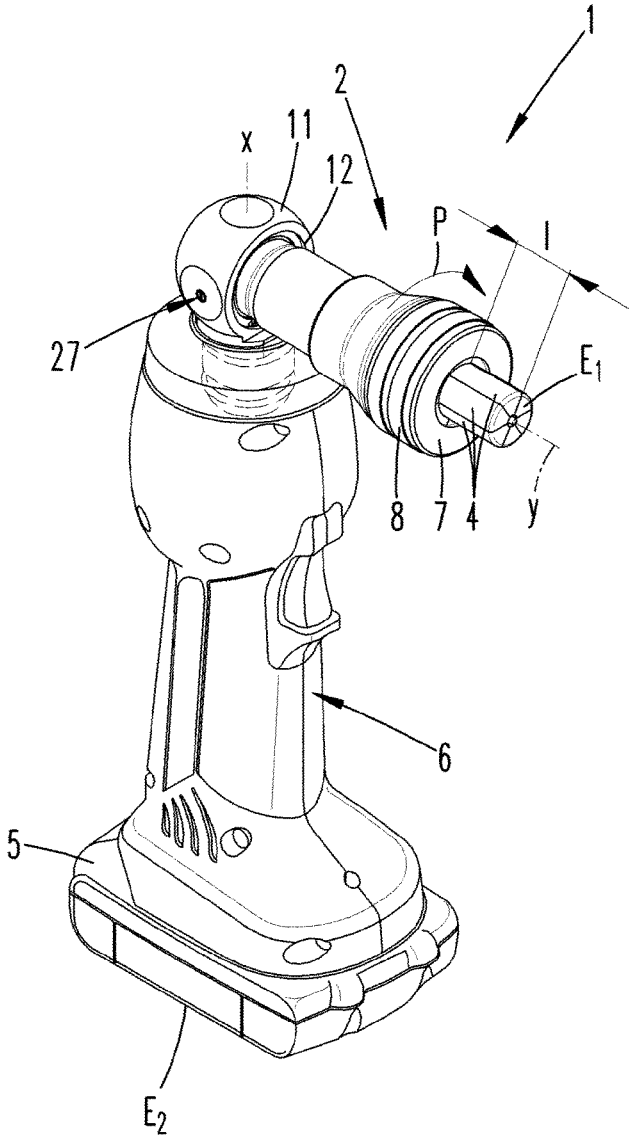
FIG. 1 is a perspective view of a motor-operable expanding apparatus.
Figure 2:
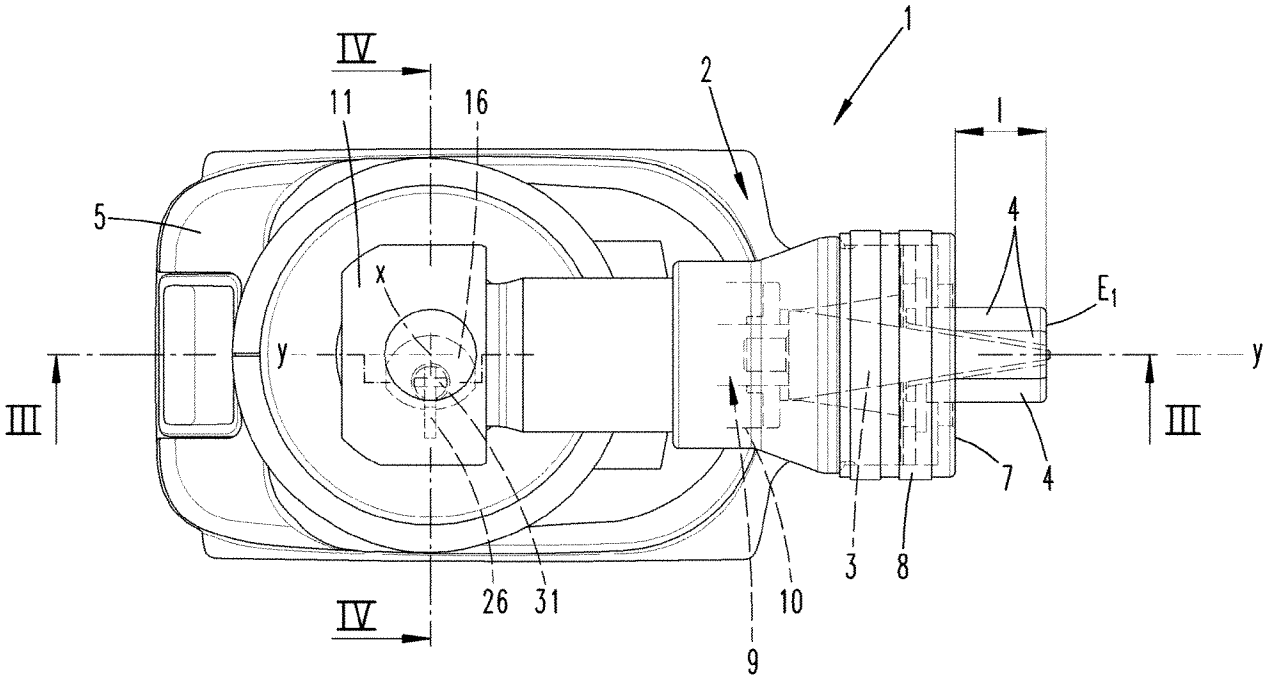
FIG. 2 is a plan view of the device of FIG. 1.

FIG. 1 illustrates and describes a portable tool configured as a portable expanding apparatus 1 having an electric motor, not shown in detail. The portable expanding apparatus 1 further has a working head in the form of an expanding head 2, which is used to expand pipe ends (see also comparison FIGS. 3 and 6). Working head 2 further comprises an actuator in the form of and expanding mandrel 3, see for example FIGS. 2 and 3.

Expanding head 2, in the exemplary embodiment together with expanding mandrel 3, is rotatable by a motor, that is to say it is ultimately triggered by the action of the electric motor. It rotates about a first longitudinal axis y, which also corresponds to the travel direction of expanding mandrel 3, see arrow P.

In greater detail, expanding head 2 comprises segments 4, which are movable radially outwardly by expanding mandrel 3 to expand a pipe end. Said segments 4 are arranged in a circular manner alongside one another. In the circumferential direction of such a circle K, see also FIG. 7, segments 4 are rotatable in the manner described, in the embodiment together with expanding mandrel 3, so that no relative motion results between expanding mandrel 3 and segments 4, at least not as a consequence of the rotation.

Expanding segments 4 and optionally a tip of expanding mandrel 3 when it is advanced so far, form a first free end $E_1$ of the expanding apparatus, and particularly of expanding head 2 of the expanding apparatus. Another free end $E_2$ is formed by rechargeable battery section 5 which here has the form of a support base. A grip section 6 of expanding apparatus 1 is conformed between first free end $E_1$ and second free end $E_2$, and extends at an angle away from first free end $E_1$ of expanding head 2 between expanding head 2 and second free end $E_2$ of the expanding apparatus. With regard to a direction of width of a user's hand holding said grip section 6, a direction of extension of the grip section is obtained that corresponds to a second longitudinal axis x of the device. Relative to a plane in which both longitudinal axes x, y lie or in which the maximum lengths thereof map each other, passing through handling section 6 and working head 2 respectively, in the case that longitudinal axes x, y do not intersect each other, it is preferred that provision is made for the drive motor, which in the embodiment is arranged inside grip section 6, to be in alignment or coaxial with second longitudinal axis x, and/or further a plug socket for rechargeable battery section 5 and the rechargeable battery section 5 itself when it is plugged in, and a gear mechanism, not shown in greater detail here, which is required for converting a rotary motion generated by the electric motor into a reciprocal motion of a pump acting on the hydraulic medium.

Longitudinal axes of x, y may also be provided in a linear extension that deviates from a right angle, particularly at an obtuse angle.

Figure 5:
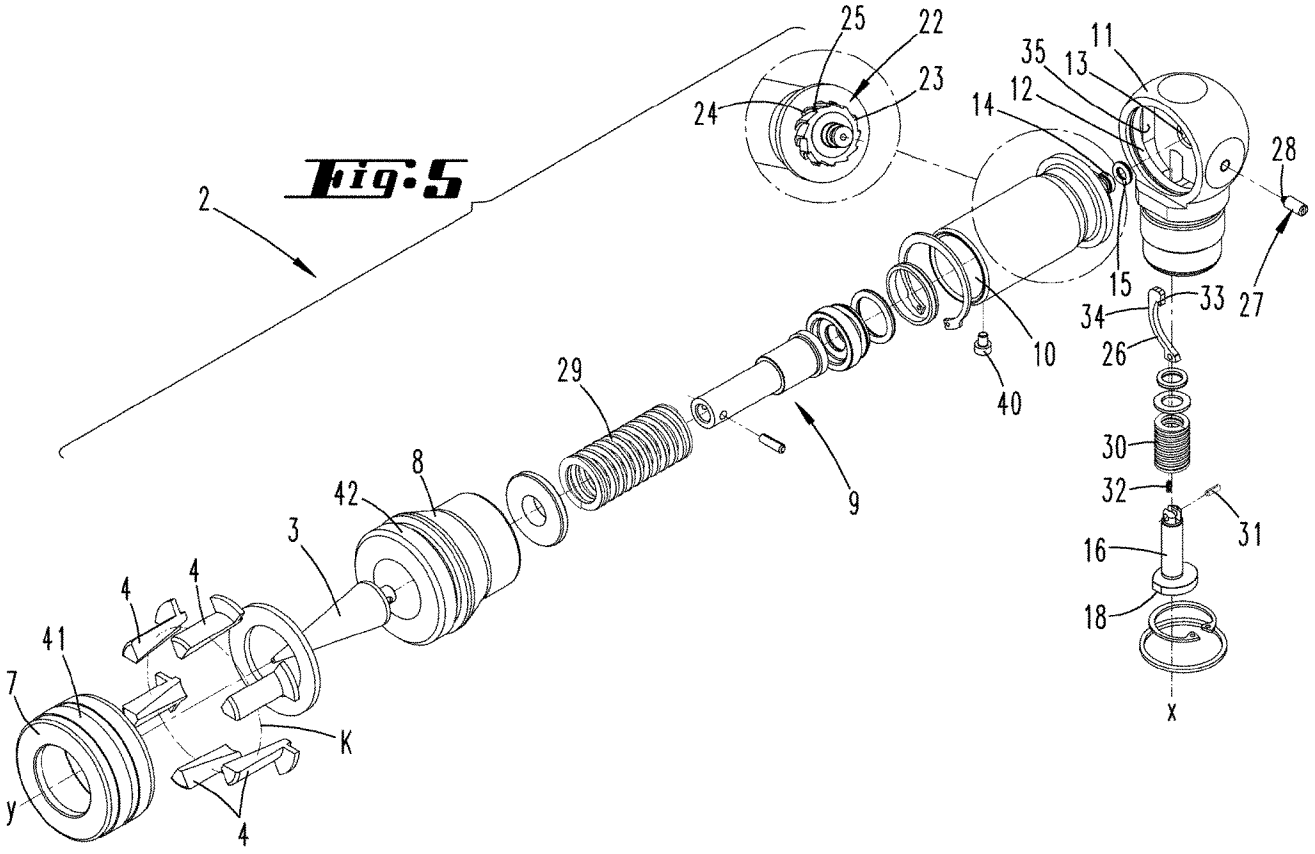
FIG. 5 is an exploded view of the essential parts of the expanding apparatus.
Figure 7:
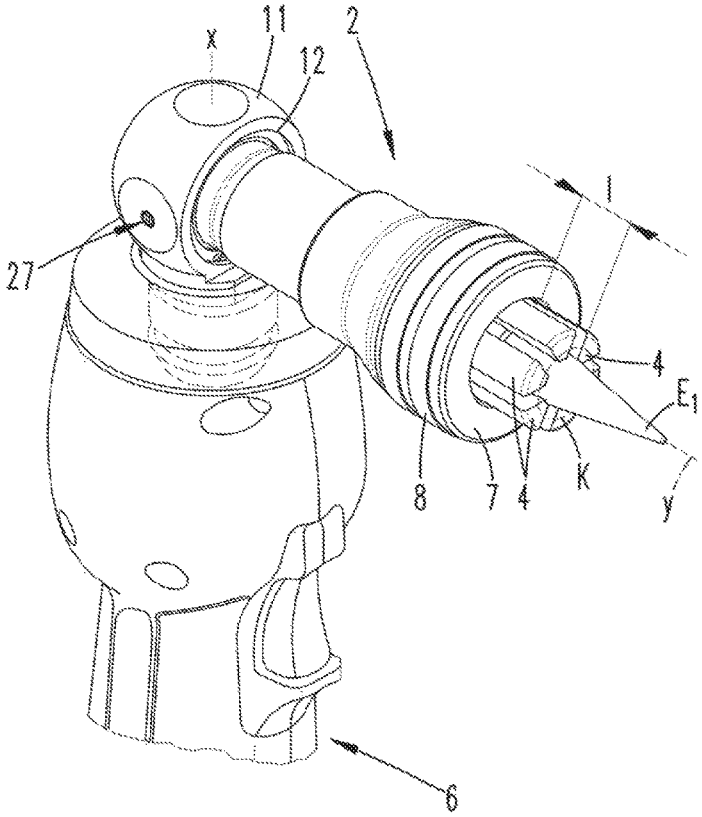
FIG. 7 is a representation according to FIG. 1 of the device in the operating position according to FIG. 6.

As may also be seen in FIG. 1, but also in FIGS. 5, 7, expanding segments 4 have a cross section in the shape of a circle segment and have a length 1 that is insertable in a pipe end, which length is preferably equal to the total diameter of the combined segments in the unactuated state, or is larger, for example as much to two to three times larger than said diameter.

A stop face 7 is conformed at the rear of the protruding area of segments 4 and is arranged vertically and in circular manner to surround segments 4. It serves to prevent segments 4 from penetrating too far into a pipe end that is to be expanded.

Figure 3:
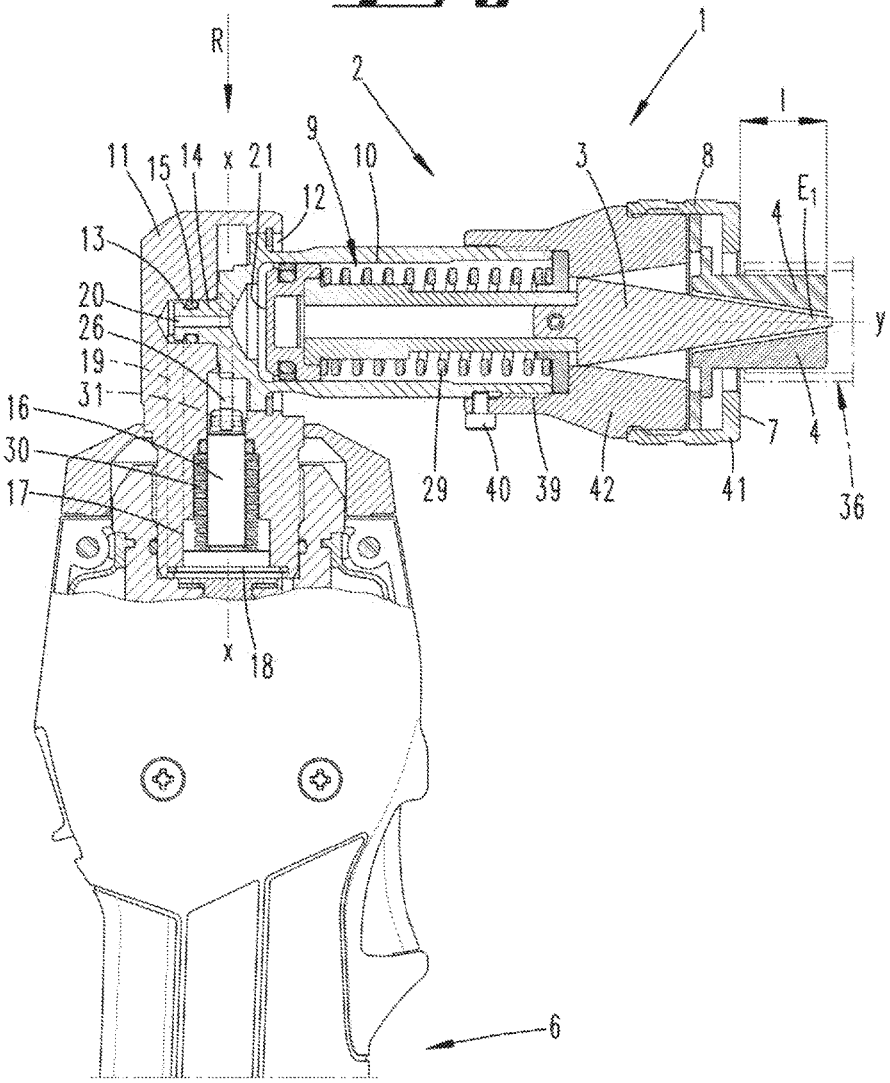
FIG. 3 is a cross section through the device of FIGS. 1 and 2 along plane III-III in the view according to FIG. 2.

Inside head part 8, which also forms stop face 7, as may be seen in FIG. 3, for example, the segments are secured so as to be radially displaceable. A spring bias, not shown here, may be provided towards the starting position of segments 4, which is visible in FIG. 3.

Expanding mandrel 3 is acted upon by a first hydraulic piston 9, which is arranged in a first hydraulic cylinder 10. Both expanding mandrel 3 and hydraulic piston 9 move along the first longitudinal axis y. In the embodiment, and preferably, wherein this is also significant for the tool in general and/or for the hydraulic piston/cylinder arrangement per se, the first hydraulic cylinder 10 together with the hydraulic piston 9 located movably therein, and the working part, in this case expanding mandrel 3 and the working head 2 as a whole is arranged rotatably.

For this purpose, first hydraulic cylinder 10 is preferably rotatably mounted in a mounting head 11. In greater detail in the embodiment, a first, larger, pot-shaped recess 12 is conformed in mounting head 11, the dimension of which recess in any case exceeds an internal diameter, but preferably also an outer diameter of first hydraulic cylinder 10. It is further preferred to provide a second recess 13, also coaxial with first longitudinal axis y and preferably has a smaller diameter, in mounting head 11, inside which second recess a tapered shaft of first hydraulic cylinder 10 is accommodated. A seal is preferably also provided only in the region of said tapered shaft 14, in the embodiment having the form of an O-ring 15 that seals said region by reason of an insertion groove. Incidentally, this also makes it possible to ensure that recess 12 remains free of hydraulic medium.

A second hydraulic piston 16 is provided, preferably aligned with second longitudinal axis x, and operates in a second hydraulic cylinder 17. This second hydraulic piston 16 is preferably provided solely to generate the rotational movement of the first hydraulic piston 10 and the working head 2.

Both the first hydraulic piston 9 and the second hydraulic piston 16 are preferably subjected to pressure from the same hydraulic medium. The same hydraulic pressure is preferably present at both hydraulic pistons 9, 16.

To this extent, a hydraulically parallel line 19, indicated in outline here, is provided outside of the load-bearing surface 18 of second hydraulic piston 16 for the hydraulic medium, which flows into recess 13 and is forwarded through a hole 20 in the tapered shaft portion 14 of the first hydraulic cylinder 10 to act on the load-bearing surface 21 of the first hydraulic piston 9.

In the direction of second longitudinal axis x, subsequently to mounting head 11, viewed in the direction of arrow R, hydraulic expanding apparatus 1 has the same construction as for example the hydraulic system known from the cited documents WO 03/084719 A2 (or U.S. Pat. No. 7,254,982 B2, U.S. Pat. No. 7,412,868 B2 or U.S. Pat. No. 7,412,877 B2). This means that a pump is connected to a return valve, preferably in a parallel arrangement, which pump is acted upon by a gear mechanism to which is then connected an electric motor, preferably located in grip section 6 as described previously, and finally a plug socket for the rechargeable battery and the rechargeable battery.

Figure 4:
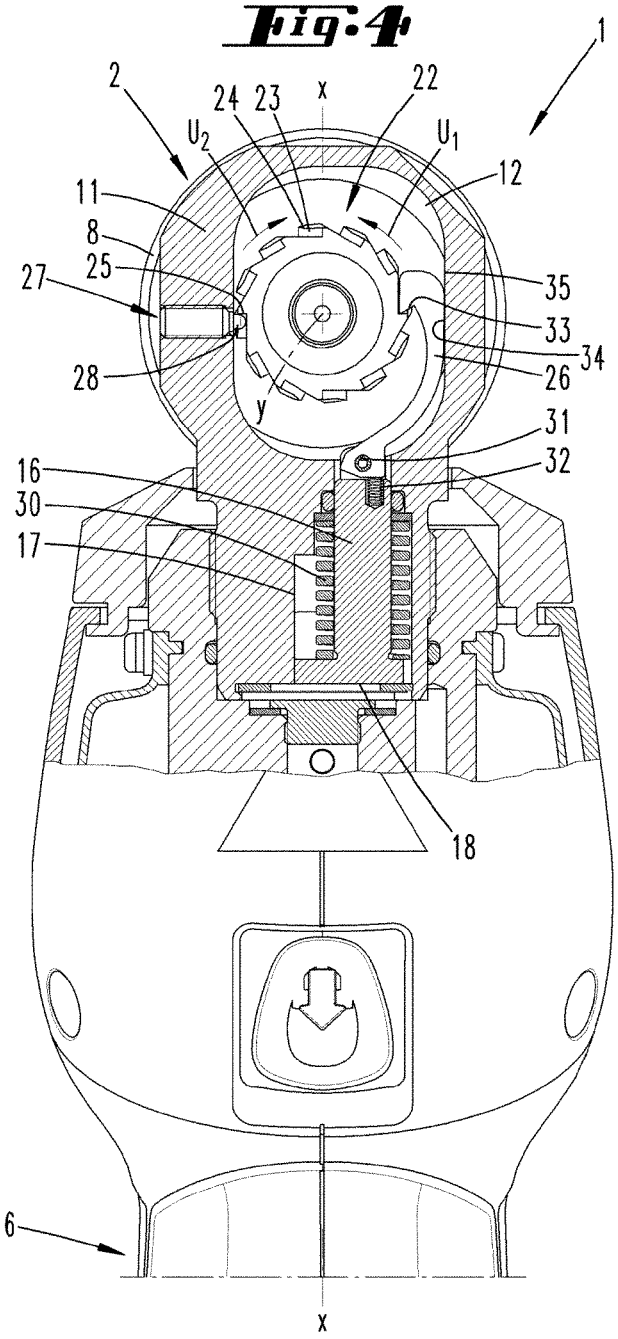
FIG. 4 is a cross-sectional view of the apparatus of FIGS. 1 and 2 along plane IV-IV in the view according to FIG. 2.

Regarding the rotating force of working head 2 and specifically of first hydraulic cylinder 10, more details are evident by referring first to FIG. 4.

As may be seen in the embodiment in FIG. 4, first hydraulic cylinder 10 comprises an external tooth system 22, preferably in the area thereof accommodated in the first recess 12, which is arranged to follow a generally circular line. Individual teeth 23 are formed so that all teeth 23 in the same direction have a projecting bevel 24 in a first circumferential direction $U_1$ and a blocking shoulder 25 in the second circumferential direction $U_2$. This extends preferably perpendicularly, or also radially, to a tangent to the aforementioned circle. In the latter case, it would accordingly have an undercut. It may also be arranged with a positive slope with respect thereto, providing the follower, which will be described subsequently, does not cause an overflow.

Figure 8:
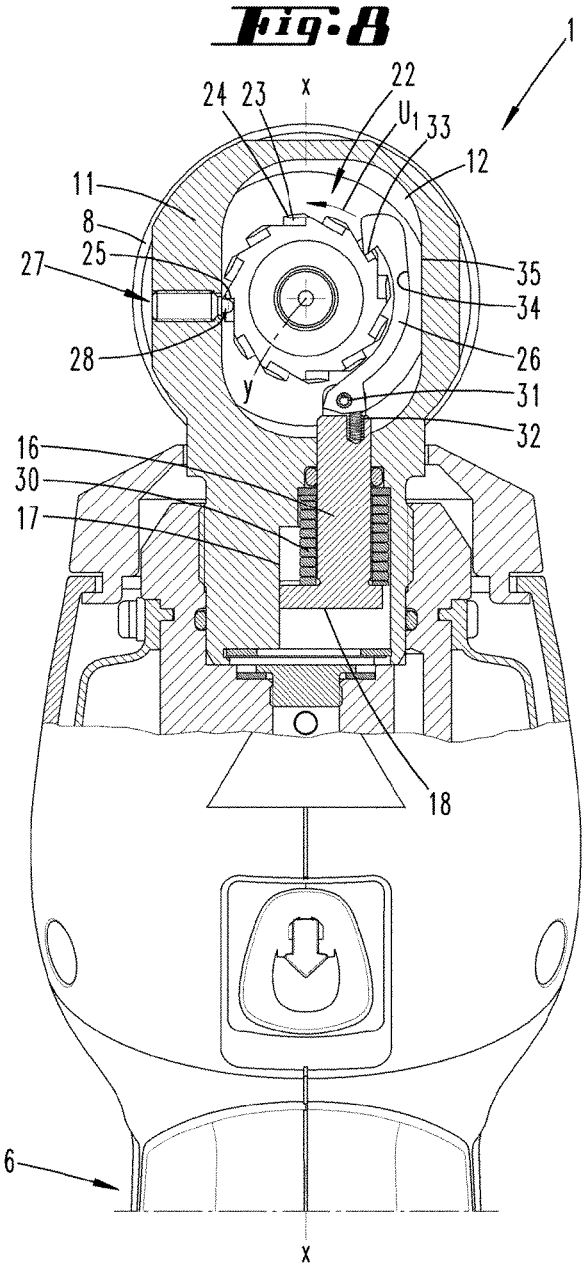
FIG. 8 is a representation according to FIG. 1 of the device in the operating position according to FIG. 6.

A follower 26 is connected to the second hydraulic piston 16, and when hydraulic piston 16 is extended, that is to say when it is under pressure, in which operating state the working part or the expanding mandrel also extends, the follower moves in a latching progression over teeth 23 one after the other in circumferential direction $U_1$, see also FIG. 8. To prevent working head 2 from rotating back in this operating state, a blocking element 27 is also provided, preferably circumferentially offset with respect to follower 26, which blocking element comprises a blocking head 28 that can be deflected against a spring force, for example. According to FIG. 4, blocking head 28 is shown in a position resting against the blocking shoulder 25 of a tooth 23 in such a manner that it blocks any tendency by working head 2 to rotate in circumferential direction $U_1$ as a result of the movement of follower 26.

Like the first hydraulic piston 9, the second hydraulic piston 16 is biased towards its starting position by a second return spring 30, see FIG. 4 for example. In this case, the load exerted when hydraulic pressure is applied by the spring force of return spring 30 on the one hand and by the effective piston face on the other hand, in the rest position of the second hydraulic piston 16, shown in FIG. 4, is greater than that of the first hydraulic piston 9 (generated there by the action of the first return spring 29 and the associated effective load surface of the first hydraulic piston 16).

In further detail, follower 26 is connected, preferably rotatably, to the second hydraulic piston 16 via a pivot pin 31. More preferably, it is biased toward an outwardly pivoted position shown in FIG. 8, in contrast to the inwardly pivoted position shown in FIG. 4, by a compression spring 32. In this way, it is assured that the leading hook section 33 of the follower 26 engages behind the next tooth 33 when second hydraulic piston 16 advances.

When the hydraulic medium has reached a maximum pressure, predetermined for the embodiment, during a compression or working movement of the working part, that is to say expanding mandrel 3, the return valve opens and both the first hydraulic piston 9 and the second hydraulic piston 16 return to their starting positions, because the counterpressure of the hydraulic medium decreases correspondingly.

During this return movement, the second hydraulic piston 16 entrains the first hydraulic cylinder 10 in circumferential direction $U_2$ via follower 26, thereby rotating working head 2.

In the initial position with respect to rotation as shown in FIG. 4, it should also be noted that the rear side 34 of follower 26 lies flush with an inner surface 35 of wall 43 of mounting head 11. Since this means that follower 26 is prevented from moving radially outwards, in such a condition in which the hydraulic medium is exerting no pressure, it is assured that first hydraulic cylinder 10 cannot rotate relative to mounting head 11 due to the effect of follower 26 on the one hand and blocking member 27 on the other.

Figure 6:
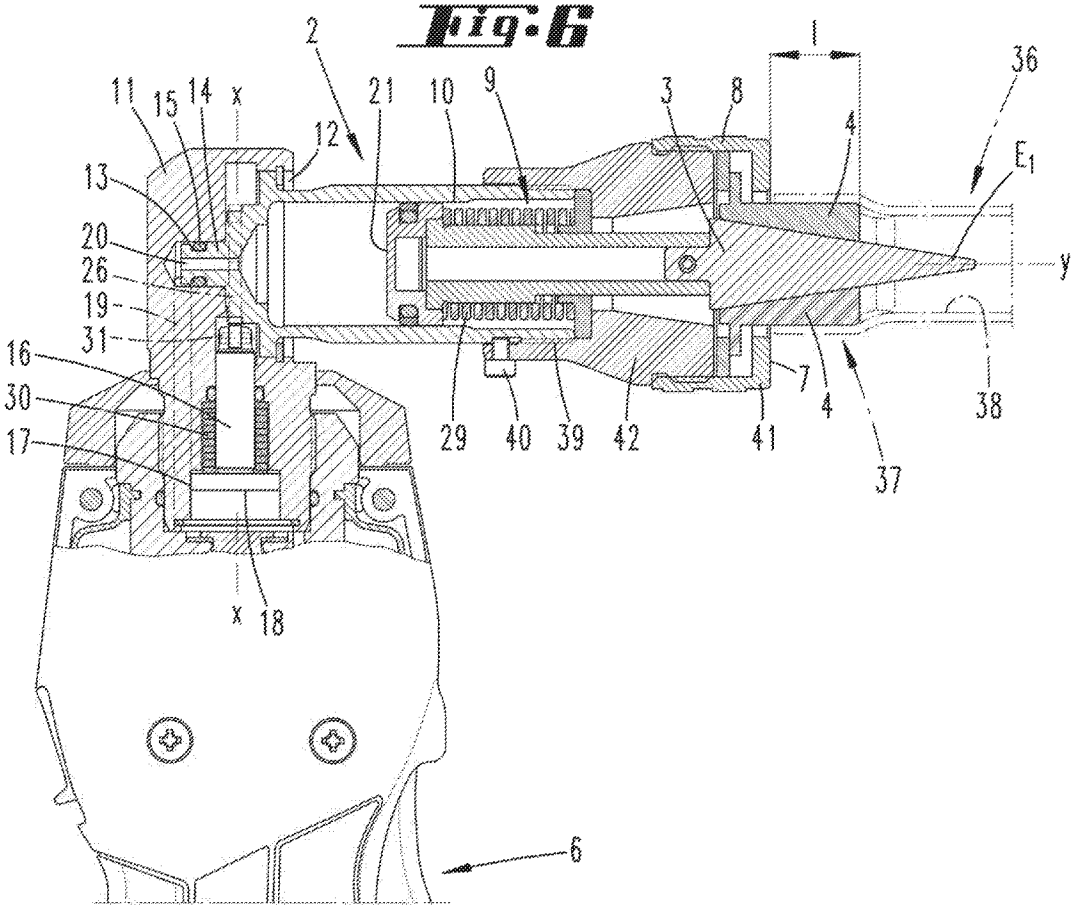
FIG. 6 is a partial cross section of the expanding apparatus in which the expanding mandrel is in the spread position and a pipe with flared end area is shown in outline.
Figure 9:
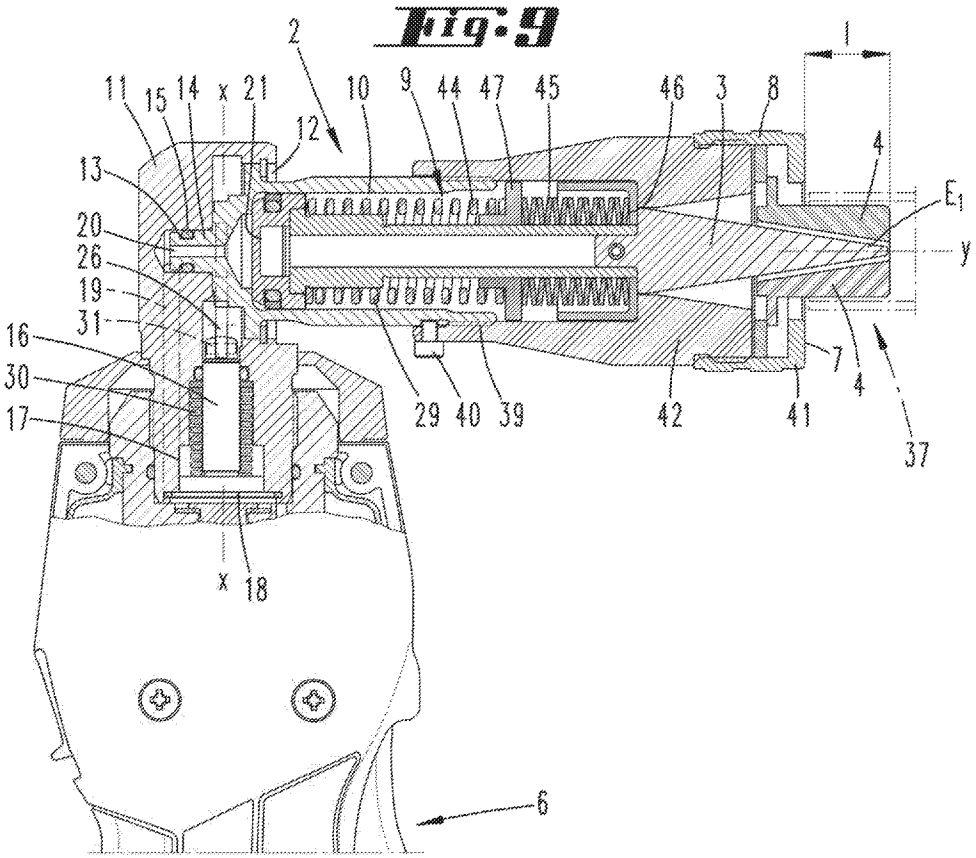
FIG. 9 is a further representation according to FIG. 3, relating to a further embodiment in the unactuated position.

FIGS. 6, 7 and 9 represent the execution and effect on a pipe end 37 of an expansion operation on an associated pipe 36. During the expansion, as shown in FIG. 6, pipe end 37 is widened radially compared with the adjoining portion of pipe 36. Segments 4 are moved into a position as shown in FIG. 7.

The return movement of the first hydraulic piston removes the pressure from the segments and they move radially inward, as shown in FIG. 9. As also shown in FIG. 9, as soon as this this movement is completed, a rotating movement is performed by first cylinder element 10 and therewith also working head 2 and particularly segments 4 relative to an inner surface 38 of pipe 36.

The movement is preferably synchronized temporally with an expansion operation in such manner that it is completed before segments 4 are separated from inner surface 38 of pipe 36, since the outer surface of segments 4 initially remain in contact with the inner surface 38 of pipe 36 under force as a consequence of an elastic shape recovery of pipe 36, which may vary depending on the material from which pipe 36 is made. Accordingly, the user's hand must absorb a certain restoring force generated by the device, which is made considerably easier by the arrangement of working head 2 and first hydraulic cylinder 10 in alignment with first longitudinal axis y and the alignment of grip section 6 with second longitudinal axis x.

Working head 2 is also attached interchangeably to first hydraulic cylinder 10. In this context, it is preferably attached such that expansion mandrel 3 is not replaced.

The releasable attachment is achieved in the embodiment with a threaded connection 39 between working head 2 and an outer surface of the first hydraulic cylinder 10, wherein a final position reached may be rendered secure by a set screw 40. Thus, different segments for use with different nominal diameters of pipes 36 may be brought into cooperation with expanding mandrel 3 very simply.

Alternatively, it is also possible for only an attachment 41 that supports segments 4 to be replaceable. Attachment 41 may be secured to the first hydraulic cylinder 10 in the manner described on the front of intermediate part 42 facing the first end of the device.

Figure 10:
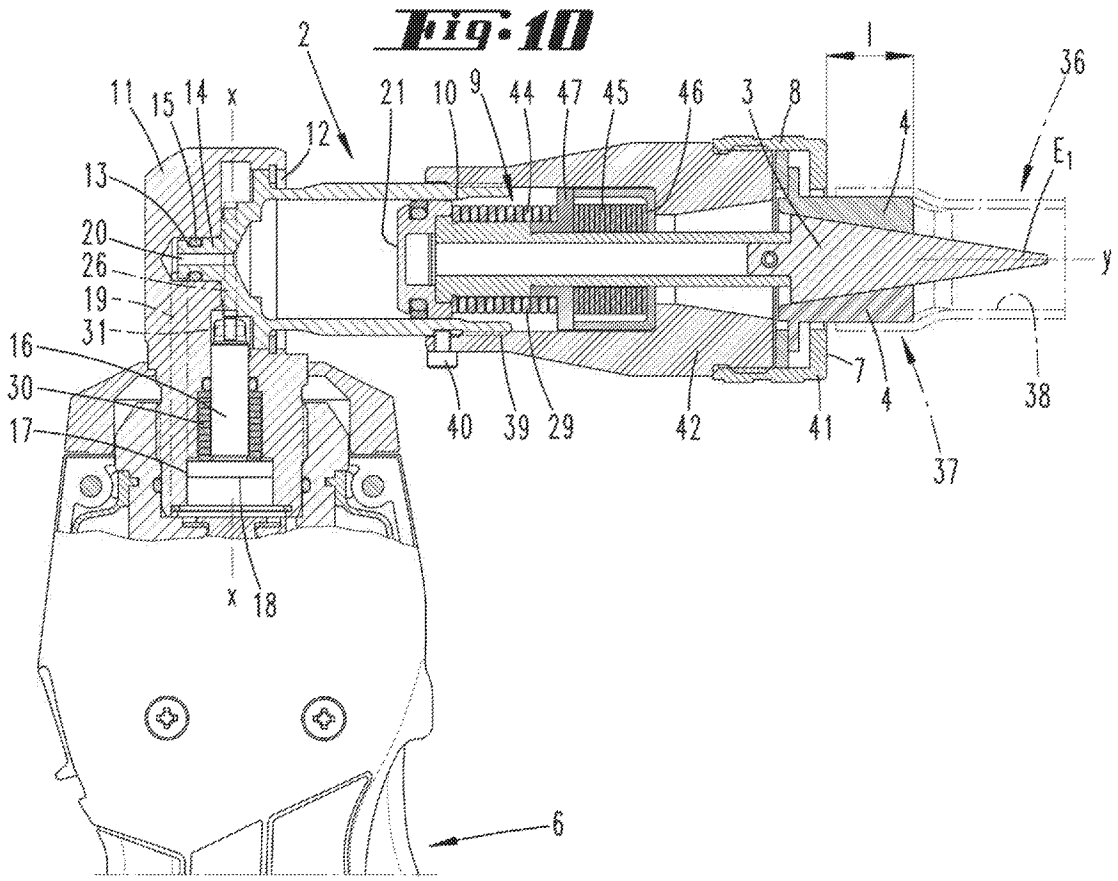
FIG. 10 is a representation according to FIG. 9 in the actuated position.

With reference to FIGS. 9 and 10, an alternative embodiment of the expanding apparatus or in more general terms of the first and second hydraulic piston/cylinder arrangement is shown.

In this case, it is noteworthy that a certain sequence characteristic with regard to retraction of the working part or the expanding shaft 3 and the rotation of first hydraulic cylinder 10 is observed.

Alternatively to the illustrated special configuration of the return spring associated with first hydraulic piston 9, such a result may also be achieved if necessary by changing the effective loading area of first hydraulic piston 9 in comparison to second hydraulic piston 16.

In the exemplary embodiment and preferably, first return spring 29 is formed in two parts. These are first spring part 44 and second spring part 45. Second spring part 45, which is associated with first free end $E_1$, has greater spring force than first spring part 44. As is shown and preferred, in the embodiment. Second spring part consists of disk springs, while first spring part is a standard helical spring.

In further detail, the spring force of first spring part 44 is preferably selected with reference to the effective loading surface of first hydraulic piston 9 such that at the beginning of the return travel, that is to say from the position shown in FIG. 10, the pressure in the hydraulic medium reaches such a level that second hydraulic piston 16 does not return until first spring part 44 of the first return spring 29 has reached its full extension.

This ensures that the working part and, specifically in the embodiment, expanding mandrel 3, has completed its return path before the rotation of first hydraulic cylinder 10 is performed.

In further detail, it is also provided that first spring part 44 is braced on one side on a frontal inner surface of first hydraulic cylinder 10, and on the other side on an intermediate flange 47, which surrounds and is movable relative to second hydraulic piston 16. At the same time, intermediate flange 47 serves to support second spring part 45 in the direction of first free end $E_1$.

Figure 11:
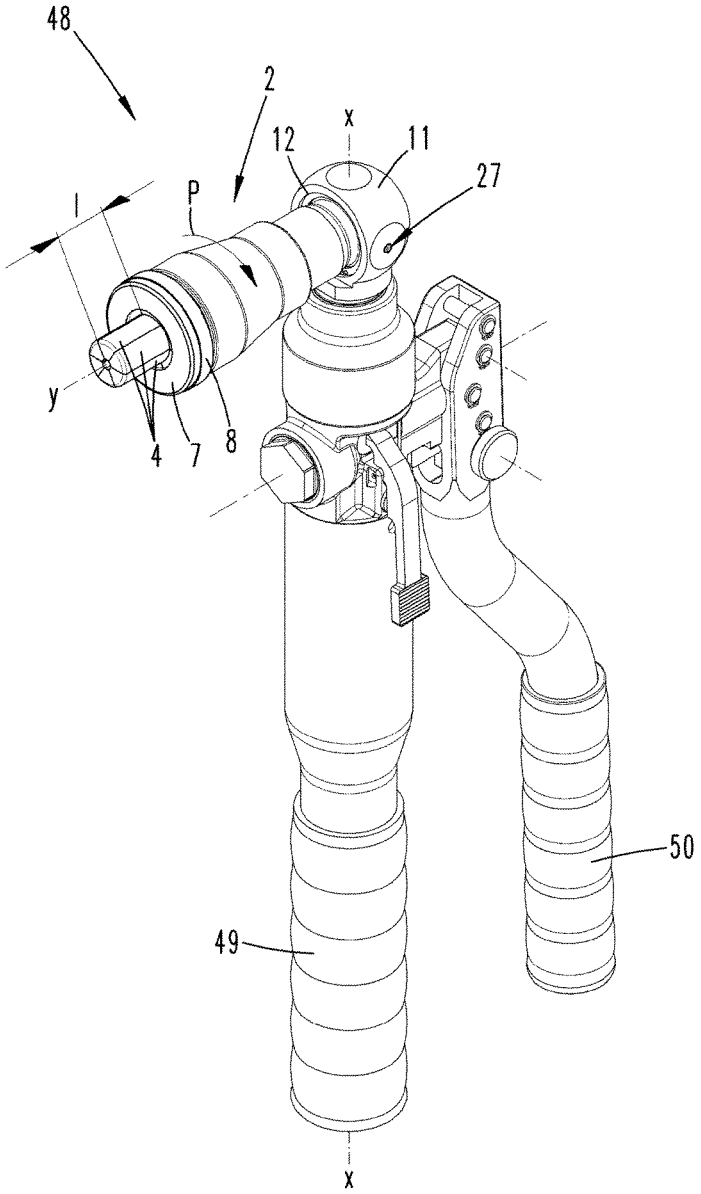
FIG. 11 shows the formation of a hydraulic portable tool with an expanding working head.
Figure 12:
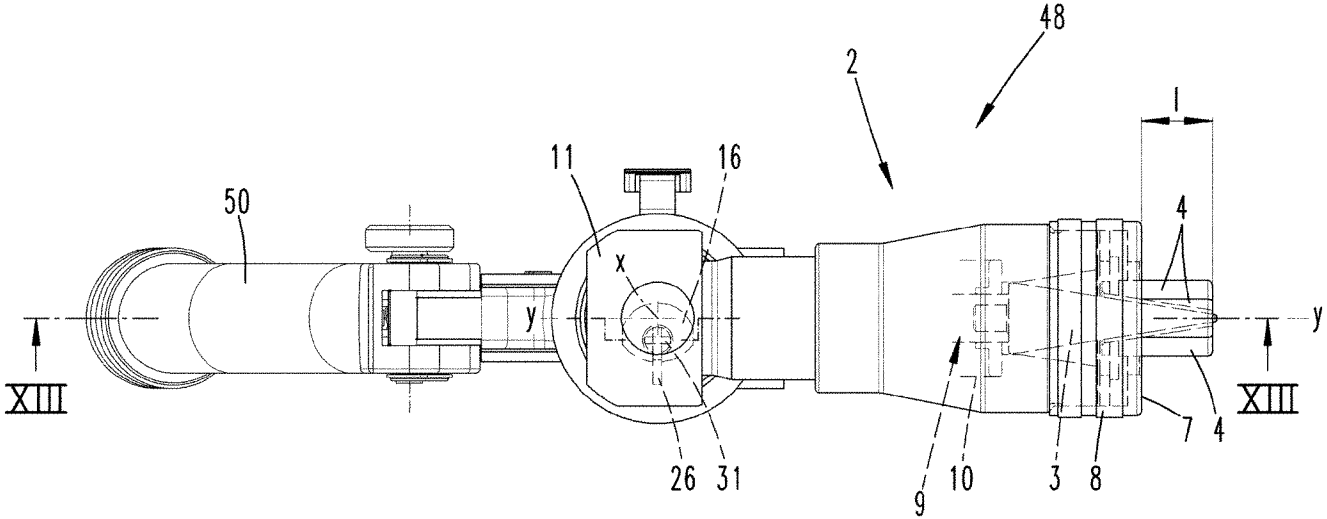
FIG. 12 is a plan view of the object according to FIG. 11.
Figure 13:
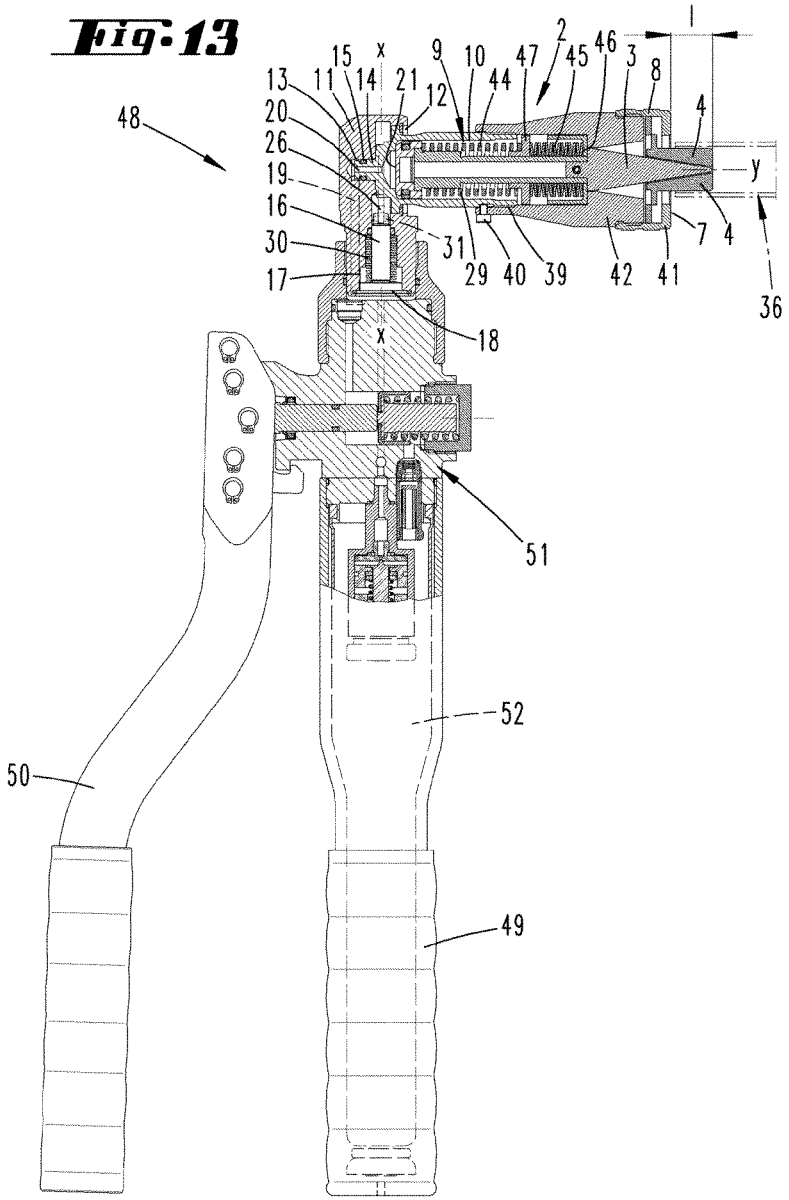
FIG. 13 shows a cross section through the object according to FIGS. 11 and 12.

With reference to the FIGS. 11 to 13, a further embodiment of a portable tool is illustrated.

Portable tool 48 is operated by pivoting handles 49 and 50. In this case, handle 49, which to this extent is attached fixedly to the working head-notwithstanding the essential here rotational mobility of the working head—may be described as a fixed handle. In contrast, handle 50 is a movable handle.

As may also be evident from FIGS. 12 and 13, a hydraulic pressure is generated using movable handle 50 via a pump assembly 51, which may constructed in detail in accordance with EP 927 305 B1 (U.S. Pat. No. 6,206,663 B1). In this embodiment, a hydraulic reservoir 52 is accommodated in fixed handle 49, for example. With the hydraulic pressure generated in this way, and the corresponding transport of hydraulic medium, second hydraulic piston 16 and first hydraulic piston 9 are then actuated to carry out an expansion operation process in the manner described previously. The performance of an expansion operation applies for this embodiment as well.

Otherwise, with regard to the working head reference is also made to the preceding description.

Figure 14:
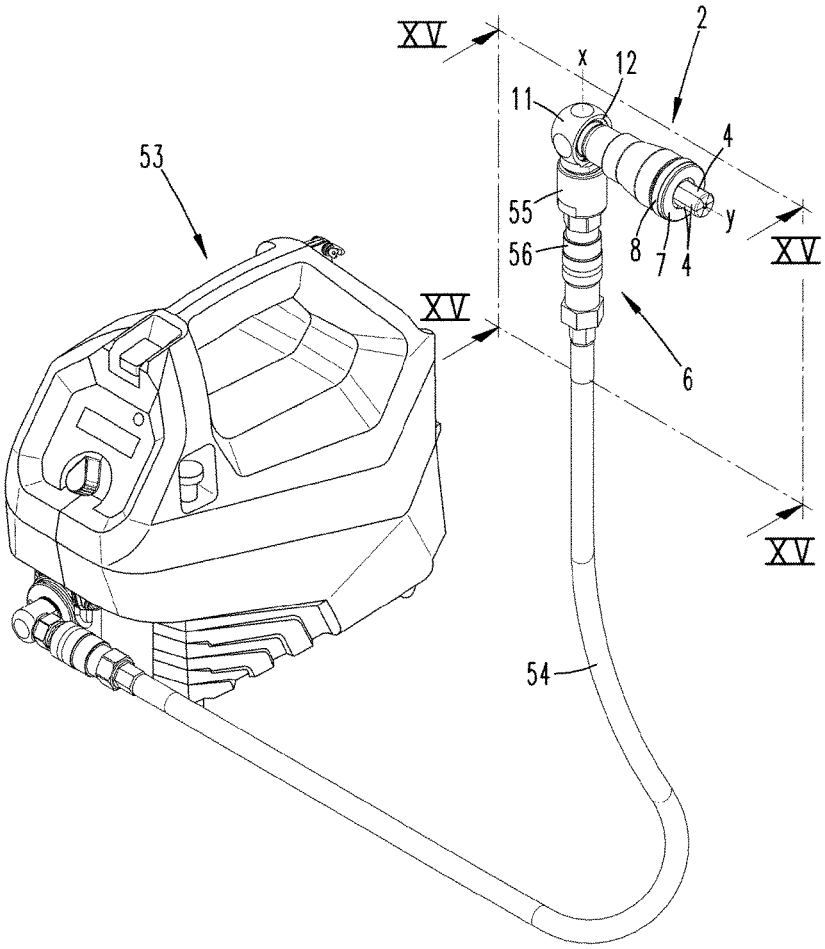
FIG. 14 is a schematic view of a free standing hydraulic unit with an expanding head connected via a hose.
Figure 15:
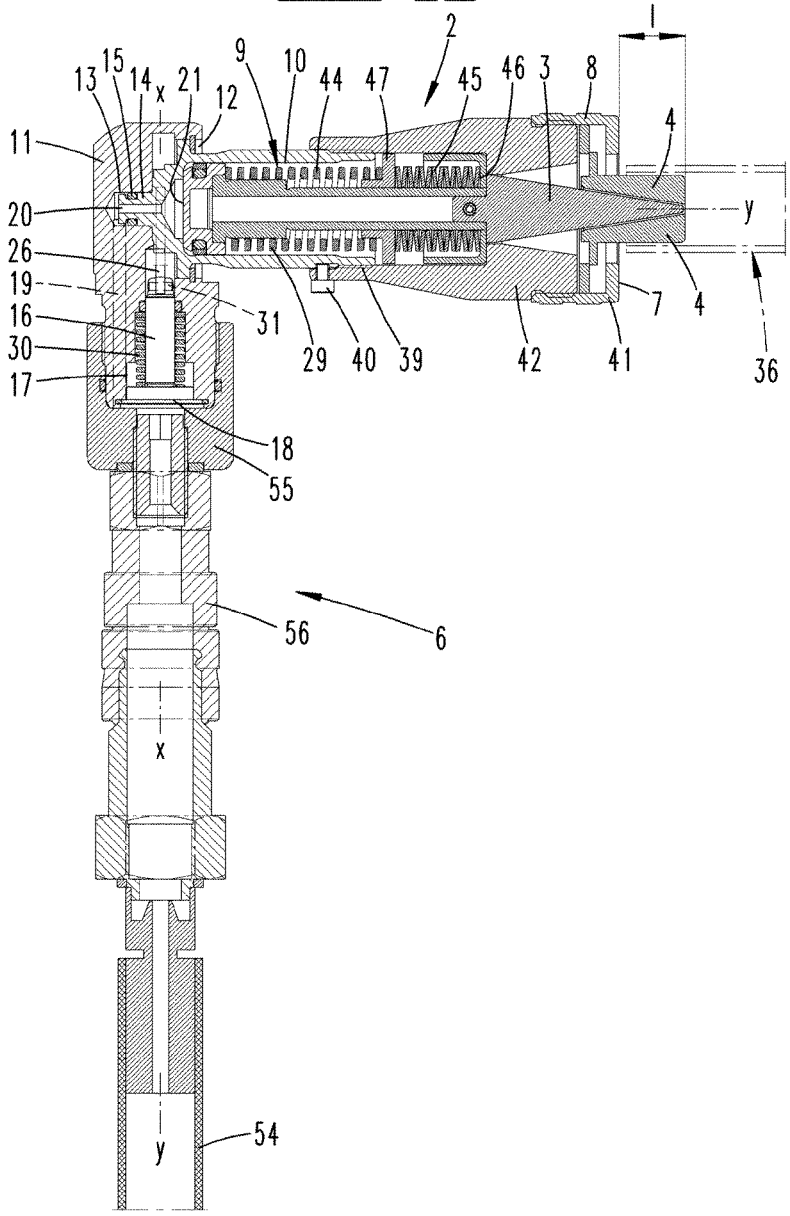
FIG. 15 is a cross-section through the object of FIG. 14 in the area of the expanding head and the hose connection.

In the embodiment of FIG. 14, a drive unit 53 is provided with which in this embodiment hydraulic pressure is generated and the hydraulic medium is passed through a connected hydraulic hose 54 to the working head, which is connected to the other end of hydraulic hose 54 via this embodiment. As may further be seen from the cross sectional view of FIG. 15, a first hydraulic piston 9 and a second hydraulic piston 16 are also provided in the working head in the same way. To this extent, the working head is equivalent to the working heads described previously, and the description of a workflow is applicable in the same way here as well.

Terminal nut 55 provides a connection to connecting member 56, to which finally hydraulic hose 54 is attached in the usual way.

Regarding all the portable tools shown, grip sections 6 are visibly created, and in the embodiment of FIGS. 11 to 13 are realized on manual levers 49, 50, by which the user holds the portable tool, in order to generate counter-torque to the torque that is created when the expansion head is rotated in a pipe that is to be expanded.

In the embodiment of FIGS. 11 to 13, a pumping action is initially required by repeated pumping movement with handles 49, 50. When the hydraulic pressure has been raised to a point where a return valve is actuated, this also initiates the spring characteristic described with respect to first and second hydraulic pistons 9 and 16, the automatic rotation of the working head together with the working part, in this case segments 4 and expanding mandrel 3. Subsequently, a new expansion operation may be performed in the manner described with this manual operation also.

All features disclosed are essential (per se) to the invention. The content of the disclosure of that associated/accompanying priority documents (transcript of the prior application) are herewith incorporated in their entirety in the present disclosure, also with the purpose of including the features of said documents in the claims of the present application. The dependent claims in their optionally coordinate version characterize independent inventive refinements of the prior art, particularly for the purpose of submitting divisional applications based on said claims.

List of reference numerals

1 Portable expanding apparatus
2 Expanding head
3 Expanding mandrel
4 Segment
5 Rechargeable battery section
6 Grip section
7 Stop face
8 Head part
9 Hydraulic piston, first
10 Hydraulic cylinder, first
11 Mounting head
12 Recess
13 Recess -continued

| List of reference numerals |
|---|
| 14 Shaft, tapered |
| 15 O-ring |
| 16 Hydraulic piston, second |
| 17 Hydraulic cylinder, second |
| 18 Load bearing surface |
| 19 Line |
| 20 Bore |
| 21 Load bearing surface |
| 22 Tooth system |
| 23 Tooth |
| 24 Projecting bevel |
| 25 Blocking shoulder |
| 26 Follower |
| 27 Blocking element |
| 28 Blocking head |
| 29 Return spring, first |
| 30 Return spring, second |
| 31 Pivot pin |
| 32 Compression spring |
| 33 Hook section |
| 34 Rear |
| 35 Inner surface |
| 36 Pipe |
| 37 Pipe end |
| 38 Inner surface |
| 39 Screw thread |
| 40 Set screw |
| 41 Attachment |
| 42 Intermediate part |
| 43 Wall |
| 44 Spring part |
| 45 Spring part |
| 46 Inner surface |
| 47 Intermediate flange |
| 48 Portable tool |
| 49 Grip, handle |
| 50 Grip, handle |
| 51 pumping arrangement |
| 52 Hydraulic reservoir |
| 53 Drive unit |
| 54 Hydraulic hose |
| 55 Terminal nut |
| 56 Connector |
| $E_1$ Free end, first |
| $E_2$ Free end, second |
| K Circle |
| 1 Length |
| R direction |
| $U_1$ Circumferential direction, first |
| $U_2$ Circumferential direction, second |
| x axis |
| y axis |

The invention claimed is:

1. A portable tool comprising:

a housing;

a rechargeable battery mounted in the housing;

a gear mechanism mounted in the housing;

an electric motor mounted in the housing;

a working head attached to the housing and rotatable relative to the housing;

a working part mounted in the working head;

a hydraulic piston engaged with the working part, wherein actuation of the hydraulic piston causes displacement of the working part within the working head in a displacement direction along a first longitudinal axis; and a plurality of segments mounted in the working head and engaged with the working part, the segments being movable radially outwardly from the first longitudinal axis when the working part is displaced in the displacement direction, each segment having an outer surface having an arc length between opposite ends thereof, wherein a circular profile is formed by the outer surfaces of the segments when the ends of the segments abut against each other, wherein the working head rotates relative to the housing in a circumferential direction around the first longitudinal axis by an angular amount, wherein the angular amount is different than the arc length of each segment, wherein the rechargeable battery, the electric motor, and the gear mechanism are configured in sequence along a second longitudinal axis which extends at an angle to the first longitudinal axis.

2. The portable tool according to claim 1, wherein the working part is movable between an operating position and a starting position, and the working head and the working part rotate while the working part is moving from the operating position to the starting position.

3. The portable tool according to claim 1, wherein the working head is rotatable without rotation angle limit for successive rotations.

4. The portable tool according to claim 1, wherein the angular amount is less than the arc length.

5. The portable tool according to claim 1, wherein the angular amount is equal to approximately half the arc length.

6. The portable tool according to claim 1, wherein rotation of the working head is always performed in the same direction of rotation.

7. The portable tool according to claim 1, wherein the hydraulic piston is mounted in a first cylinder, and further comprising a second hydraulic piston mounted in a second cylinder, wherein rotation of the working head via a hydraulic medium is effected by the movement of second hydraulic piston, wherein the second hydraulic piston is loaded into a starting position with a greater biasing force than the first hydraulic piston.

8. The portable tool according to claim 7, wherein the first return spring comprises two spring parts.

9. The portable tool according to claim 8, wherein the spring parts have different restoring forces.

10. The portable tool according to claim 1, wherein a section of the housing forms a grip section configured to be gripped by a user.

11. A portable tool comprising:

a housing;

a working head attached to the housing and rotatable relative to the housing;

a working part mounted in the working head;

a hydraulic piston mounted in a hydraulic cylinder, the hydraulic piston being engaged with the working part, wherein actuation of the hydraulic piston causes displacement of the working part within the working head in a displacement direction along an axis;

a return spring biasing the hydraulic piston towards a starting position; and a plurality of segments mounted in the working head and engaged with the working part, the segments being movable radially outwardly from the axis when the working part is displaced in the displacement direction, each segment having an outer surface having an arc length between opposite ends thereof, wherein a circular profile is formed by the outer surfaces of the segments when the ends of the segments abut against each other, wherein the working head rotates relative to the housing in a circumferential direction around the axis by an angular amount, wherein the angular amount is different than the arc length of each segment.

12. The portable tool according to claim 11, wherein a section of the housing forms a grip section configured to be gripped by a user.

13. A method comprising:

providing a portable tool with a working head having a working part, the working head comprising a first hydraulic piston mounted within a first cylinder, the first hydraulic piston being biased into a starting position by a first return spring having a spring force, and a second hydraulic piston mounted within a second cylinder, the second hydraulic piston being biased into a starting position by a second return spring having a spring force, the second hydraulic piston defining a hydraulic effective area, the working head being configured to be actuated by an electric motor and by a hydraulic medium, wherein the working part is moveable in a displacement direction, and wherein the working head is rotatable together with the working part in a circumferential direction with respect to the displacement direction; and loading the second hydraulic piston into a starting position with a greater biasing force than the first hydraulic piston due to the spring force from the respective return spring and due to the hydraulic effective area of the second piston upon which the hydraulic medium acts, wherein the first hydraulic piston and the second hydraulic piston are activated the hydraulic medium;

upon triggering of a movement of the working part, the working head and working part are rotated without further user intervention, wherein rotation of the working head is effected by movement of the first hydraulic piston within the first cylinder and movement of the second hydraulic piston within the second cylinder, the first hydraulic piston acting on the working part;

after triggering of a return movement of the first hydraulic piston, initially an at least partial return of the working part is effected, and rotation of the first hydraulic cylinder occurs immediately thereafter; and turning the working head by using the second hydraulic piston after a return movement of the first hydraulic piston via the first return spring in the starting position has started.

14. The method of claim 13, wherein the rotation is effected by the hydraulic medium being placed under pressure by the motor.

* * * * *